US007765834B2

(12) United States Patent
Ando

(10) Patent No.: US 7,765,834 B2
(45) Date of Patent: Aug. 3, 2010

(54) DOUBLE-CYLINDER CIRCULAR KNITTING MACHINE FOR HOSIERY OR OTHER KNITTED ARTICLES

(75) Inventor: Jan Ando, Brno (CZ)

(73) Assignee: Lonati S.p.A., Brescia (IT)

( * ) Notice: Subject to any disclaimer, the term of this patent is extended or adjusted under 35 U.S.C. 154(b) by 0 days.

(21) Appl. No.: 12/225,913

(22) PCT Filed: Mar. 28, 2007

(86) PCT No.: PCT/EP2007/002766

§ 371 (c)(1),
(2), (4) Date: Mar. 3, 2009

(87) PCT Pub. No.: WO2007/112915

PCT Pub. Date: Oct. 11, 2007

(65) Prior Publication Data

US 2009/0205376 A1 Aug. 20, 2009

(30) Foreign Application Priority Data

Mar. 31, 2006 (IT) ..... MI06A0636

(51) Int. Cl.
*D04B 9/10* (2006.01)

(52) U.S. Cl. ..... 66/14; 66/17

(58) Field of Classification Search ..... 66/7, 66/8, 13, 17, 18, 116, 123, 14
See application file for complete search history.

(56) References Cited

U.S. PATENT DOCUMENTS

| | | | | | |
|---|---|---|---|---|---|
| 3,678,710 | A * | 7/1972 | Gostelow | 66/14 |
| 4,073,163 | A * | 2/1978 | Lonati | 66/14 |
| 4,541,253 | A * | 9/1985 | Luchi et al. | 66/14 |
| 5,275,021 | A * | 1/1994 | Fucik | 66/57 |
| 5,367,893 | A * | 11/1994 | Fucik | 66/222 |
| 6,220,061 | B1 | 4/2001 | Ando et al. | |
| 2003/0101775 | A1 | 6/2003 | Ando | |
| 2006/0150686 | A1 | 7/2006 | Lonati et al. | |

* cited by examiner

*Primary Examiner*—Danny Worrell
(74) *Attorney, Agent, or Firm*—Husch Blackwell Sanders LLP Welsh & Katz

(57) ABSTRACT

A double-cylinder circular knitting machine for hosiery or other knitted articles comprises a lower needle cylinder with a vertical axis and an upper needle cylinder arranged above and coaxially to the lower needle cylinder. Aligned axial slots are formed on the lateral surface of the lower and upper needle cylinders. Each of the axial slots of the lower and upper needle cylinders accommodates an actuation element which can engage a needle to be actuated and is provided with a fixed heel, and with a heel which can be extracted radially on command from the axial slot. The transfer of a needle from one needle cylinder to the other is performed by fixed cams and by a selection device producing transition into the extracted position of the movable heel exclusively of the actuation elements that correspond to the needles to be moved to the lower needle cylinder.

13 Claims, 3 Drawing Sheets

DOUBLE-CYLINDER CIRCULAR KNITTING MACHINE FOR HOSIERY OR OTHER KNITTED ARTICLES

TECHNICAL FIELD

The present invention relates to a double-cylinder circular knitting machine for hosiery or other knitted articles.

BACKGROUND

As is known, double-cylinder circular machines for knitting hosiery generally comprise a lower needle cylinder which has a vertical axis and an upper needle cylinder arranged upwardly and coaxially with respect to the lower needle cylinder; said cylinders can be actuated rigidly with each other with a rotary motion about the common axis.

Multiple axial slots are formed on the lateral surface of the lower needle cylinder and on the lateral surface of the upper needle cylinder. The axial slots of the upper needle cylinder are aligned with the axial slots of the lower needle cylinder. Each of the axial slots of the lower needle cylinder generally accommodates, starting from the bottom, a selector and a slider, while each of the axial slots of the upper needle cylinder accommodates a slider. Between the two needle cylinders, i.e., in the knitting region, in each of the axial slots, there is a needle which is provided with two tips or heads, respectively an upper head and a lower head; depending on whether one wishes to provide plain or purl stitches, said needle is moved within the lower needle cylinder so that it knits with its upper tip or in the upper needle cylinder so that it knits with its lower tip.

Since the needle is not provided with a heel, it is actuated by means of the slider arranged in the lower needle cylinder or by means of the slider arranged in the upper needle cylinder, depending on whether it has to form plain or purl stitches.

The sliders currently used in double-cylinder circular knitting machines for hosiery are constituted generally by an elongated laminar body, which has a first longitudinal side designed to rest on the bottom of the axial slot formed on the lateral surface of the lower needle cylinder or on the lateral surface of the upper needle cylinder.

Such sliders are further provided with two heels, which are mutually spaced along the length of the slider and protrude transversely from a second longitudinal side of the slider which lies opposite the first side.

These heels are used to produce the movement of the slider along the corresponding axial slot of the lower or upper needle cylinder so as to produce the actuation of the needle, which is associated with said slider, in the various kinds of knitting of the machine or to transfer the needle from one needle cylinder to the other.

The slider is further provided, on its first longitudinal side, i.e., on its side directed toward the bottom of the axial slot within which it is accommodated, with a hook-shaped tab, which engages the lower head of the needle or the upper head depending on whether the slider is in the lower needle cylinder or in the upper needle cylinder.

Multiple cams for actuating the sliders are arranged around the lateral surface of the lower needle cylinder and around the lateral surface of the upper needle cylinder and form a series of paths, with which the heels of the sliders engage when the needle cylinders are actuated with a rotary motion about their own axis with respect to said cams. The paths formed by the cams are shaped so as to produce the movement of the sliders along the axial slots of the needle cylinders in which they are accommodated and consequently produce the actuation of the needles associated therewith.

In currently commercially available double-cylinder circular knitting machines for hosiery or other knitted articles, many of the cams that form the paths for the heels of the sliders are provided so that they can move along a radial direction with respect to the needle cylinders, so that they can be moved from an active position, in which they are close to the needle cylinders so that they are engaged by the heels of the sliders, to an inactive position, in which they are spaced from the needle cylinders so as to not interfere with the heels of the sliders, or vice versa, in order to allow to vary the paths for the heels of the sliders and consequently vary the kinds of knitting that the machine can perform.

In particular, in these machines, in order to transfer a needle from the upper needle cylinder to the lower needle cylinder or vice versa, slider actuation cams are used which can move on command toward and away from the axis of the needle cylinders.

More particularly, when it is necessary to transfer the needles from one needle cylinder to the other, the needles that must be transferred from the lower needle cylinder to the upper needle cylinder are selected beforehand by selecting the corresponding sliders arranged in the lower needle cylinder by means of an appropriately provided selection device, which faces the lateral surface of the lower needle cylinder, and the actuation cams of the sliders required for the transfer operation are moved into the active position.

Subsequently, both the sliders arranged in the lower needle cylinder and the sliders arranged in the upper needle cylinder engage, with one of their heels, respectively a first lower movable lifting cam and a first upper movable lowering cam, so that the sliders arranged in the lower needle cylinder and the sliders arranged in the upper needle cylinder move mutually closer, reaching a position for engaging the head of the corresponding needle. This mutual approach, as a consequence of the particular shape of the end of the sliders that can engage the head of the corresponding needle, produces the oscillation, on a radial plane of the needle cylinder, of the sliders that were not engaged with the corresponding needle, causing their longitudinal end which can engage the corresponding needle to move away from the bottom of the corresponding axial slot. These sliders subsequently engage fixed pressers, which face laterally the lateral surface of the needle cylinders and cause the oscillation of the sliders in the opposite direction, i.e., moving their end which can engage the needle toward the bottom of the corresponding axial slot, thus achieving simultaneous engagement with the heads of the needle both of the sliders arranged in the lower needle cylinder and of the sliders arranged in the upper needle cylinder. The sliders arranged in the upper needle cylinder thus engage another presser, which faces the lateral surface of the upper needle cylinder and produces the oscillation of the sliders arranged in the upper needle cylinder, moving their end which can engage the upper head of the needle away from the bottom of the corresponding axial slot, disengaging them from said upper head of the needle. The sliders arranged in the lower needle cylinder therefore engage a first lower movable lowering cam, which produces their lowering, while the sliders arranged in the upper needle cylinder engage an upper fixed lifting cam. In this manner, the needles are engaged exclusively with the sliders arranged in the lower needle cylinder. Directly after the first lower movable lowering cam, the sliders that were previously selected, i.e., the sliders that must transfer the corresponding needle from the lower needle cylinder to the upper needle cylinder, are raised by the corresponding selector, while the sliders arranged in the upper needle cylinder are lowered by virtue of the action of a second upper movable lowering cam. This lowering achieves the engagement of the sliders arranged in the upper needle cylinder with the head of the needles that were raised by the lifting of the sliders arranged in the lower needle cylinder, with the consequent oscillation of the sliders arranged in the upper needle cylinder which moves their end that can engage the head of the needle away from the bottom of the corresponding axial slot. These sliders are thus made to oscillate in the opposite direction by engagement with another presser, which faces the lateral surface of the upper needle cylinder, and engage the upper head of the corresponding needle. The sliders arranged in the lower needle cylinder that were raised previously encounter another presser, which faces the lateral surface of the lower needle cylinder and produces their oscillation, with consequent spacing of their end which can engage the lower head of the needle away from the bottom of the corresponding axial slot.

The sliders arranged in the upper needle cylinder that have engaged the upper head of the needle are then raised as a consequence of engagement with another upper fixed lifting cam, which faces the lateral surface of the upper needle cylinder.

At this point, the transfer of preset needles from the lower needle cylinder to the upper needle cylinder is completed, while the other needles, which have not been selected, remain engaged with the sliders in the lower needle cylinder.

The presence of movable cams for actuating the machine, in particular for transferring the needles from one needle cylinder to the other of the machine, is unwanted, since it increases considerably the complexity of the actuation of the machine and forces the adoption of particular control devices in order to allow correct restarting of the machine if electric power accidentally fails.

Moreover, the fact that in known types of machines the needles are transferred from one needle cylinder to the other primarily by transferring all the needles from the upper needle cylinder to the lower needle cylinder requires the use of a rather large needle cylinder sector, causing problems for accommodating other cams or other devices required for correct operation of the machine.

DISCLOSURE OF THE INVENTION

The aim of the present invention is to solve the problems described above by providing a double-cylinder circular knitting machine for hosiery or other knitted articles in which the elements required to transfer the needles from one needle cylinder to the other are simplified considerably with respect to those of known types of machines.

Within this aim, an object of the invention is to provide a machine in which the cams used to transfer the needles from one needle cylinder to the other can be of the fixed type, i.e., do not require actuators to be actuated at transfer time.

Another object of the invention is to provide a machine in which the needles can be transferred from one needle cylinder to the other in a short time and very precisely and reliably.

This aim and these and other objects, which will become better apparent hereinafter, are achieved by a double-cylinder circular knitting machine for hosiery or other knitted articles, which comprises a lower needle cylinder which has a vertical axis and an upper needle cylinder which is arranged above and coaxially with respect to said lower needle cylinder; mutually aligned axial slots being formed on the lateral surface of the lower needle cylinder and on the lateral surface of the upper needle cylinder, each of the axial slots of the lower needle cylinder and of the upper needle cylinder accommodating at least one element for actuating a needle; said actuation element being engageable, by means of one of its ends, with the head of a needle and being provided with at least one fixed heel, which protrudes radially from the lateral surface of the corresponding needle cylinder to engage actuation cams which are arranged around the lateral surface of the needle cylinders and form paths which can be followed by said fixed heel as a consequence of the actuation of said needle cylinders with a rotary motion about their own axis with respect to said actuation cams, characterized in that at least the actuation elements arranged in the lower needle cylinder are provided with a heel which can move on command from an active position, in which it protrudes radially from the corresponding axial slot of the needle cylinder to engage said actuation cams, to an inactive position, in which it is contained in said axial slot of the needle cylinder so as to not engage said actuation cams, and vice versa, and in that it comprises, sequentially along the path followed by the actuation elements as a consequence of the rotation of the needle cylinders with respect to the actuation cams:

- an upper fixed lowering cam, which can be engaged by the actuation elements arranged in the upper needle cylinder for their lowering into a position for engaging the upper head of the corresponding needle, and a lower fixed lifting cam, which can be engaged by the actuation elements arranged in the lower needle cylinder to raise them into a position for engaging the lower head of the corresponding needle;
- a transfer selection device, which is adapted to move the actuation elements that correspond to the needles to be transferred into the lower needle cylinder so that their movable heel is in the active position, and an upper opening presser, which can engage the actuation elements arranged in the upper needle cylinder to produce their disengagement from the upper head of the corresponding needle;
- a lower fixed lowering cam, which can be engaged exclusively by the actuation elements arranged in the lower needle cylinder and moved with their movable heel into the active position by said transfer selection device;
- a lower opening presser, which can be engaged exclusively by the actuation elements that are arranged in the lower needle cylinder and are arranged so that their movable heel is in the inactive position in order to disengage them from the lower head of the corresponding needle;
- an upper closure presser, which can engage the actuation elements arranged in the upper needle cylinder for their engagement with the corresponding needle, if present;
- an upper fixed lifting cam, which can be engaged by the actuation elements located in the upper needle cylinder.

BRIEF DESCRIPTION OF THE DRAWINGS

Further characteristics and advantages of the invention will become better apparent from the description of a preferred but not exclusive embodiment of the machine according to the invention, illustrated by way of non-limiting example in the accompanying drawings, wherein.

WAYS TO CARRYING OUT THE INVENTION

Figure 1:
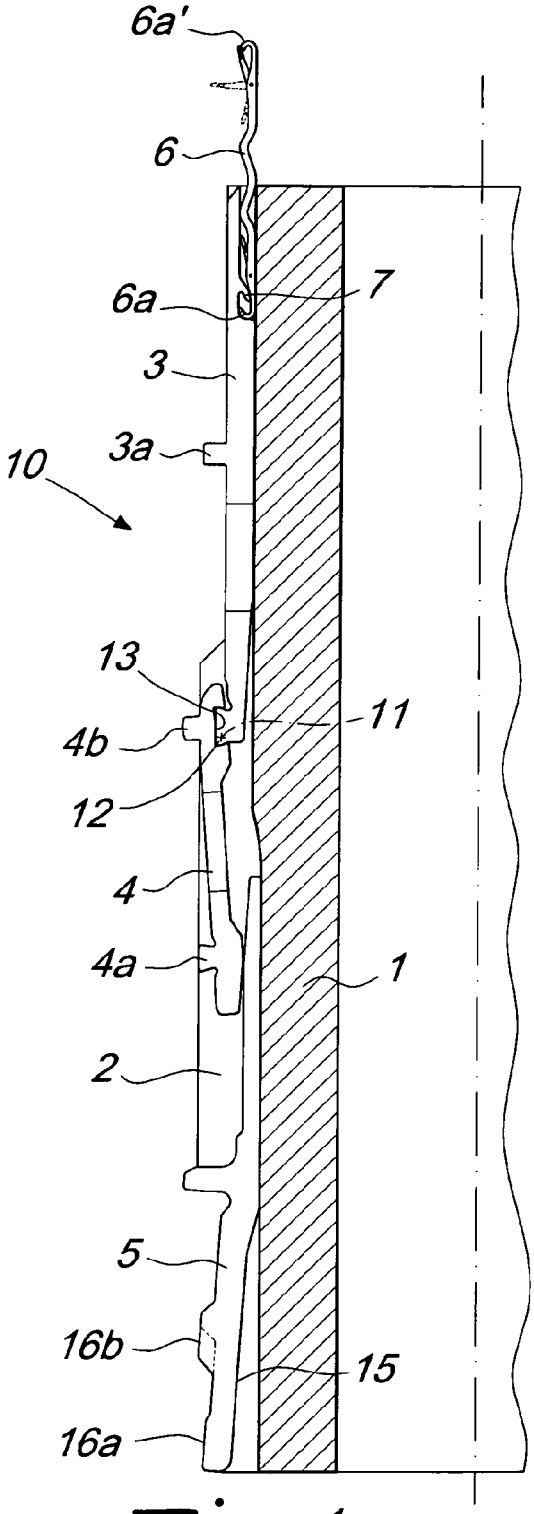
FIG. 1 is an axial sectional view of a portion of the lower needle cylinder of a double-cylinder circular knitting machine according to the invention with the heel of the actuation element in the inactive position.

With reference to the figures, the machine according to the invention, show only partially for the sake of simplicity, comprises a lower needle cylinder 1, which has a vertical axis, and an upper needle cylinder 1', which is arranged above and coaxially with respect to the lower needle cylinder 1.

Multiple axial slots 2 are formed on the lateral surface of the lower needle cylinder 1, and each slot accommodates a lower actuation element 10 for a needle 6 when it is arranged in the lower needle cylinder 1. Preferably, said lower actuation element 10 comprises, from the top downwardly, a transfer sinker or slider 3, a connecting element 4 and a selector 5.

Multiple axial slots are formed on the lateral surface of the upper needle cylinder so that each axial slot 2 of the lower needle cylinder 1 is aligned with an axial slot of the upper needle cylinder.

Figure 2:
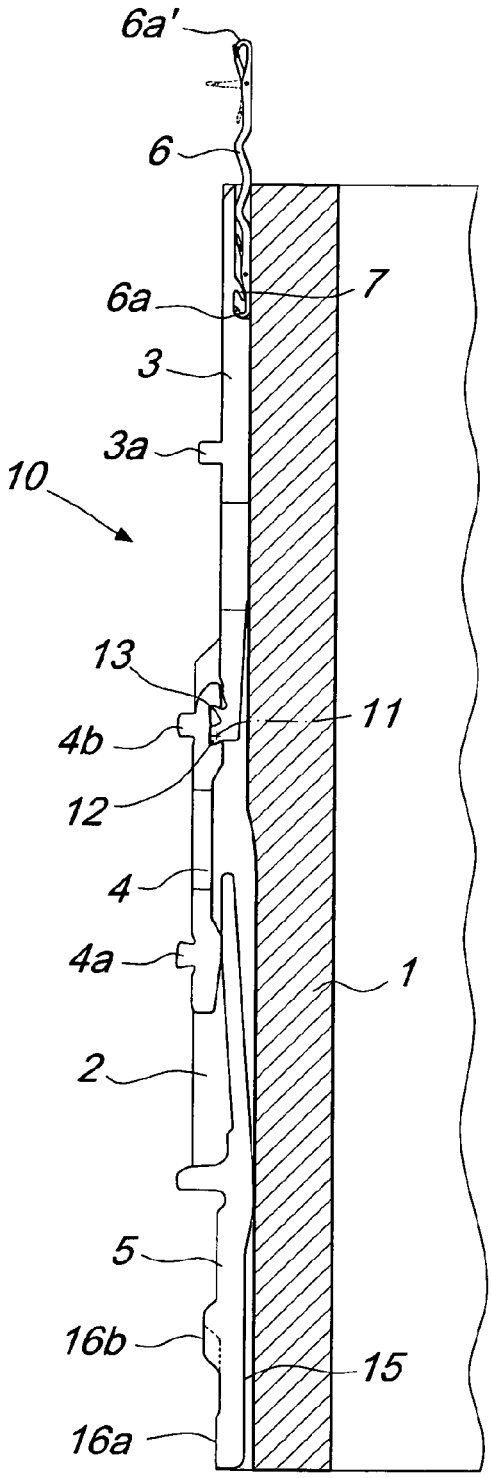
FIG. 2 is an axial sectional view of a portion of the lower needle cylinder of a double-cylinder circular knitting machine according to the invention with the heel of the actuation element in the active position.

Each axial slot of the upper needle cylinder accommodates a corresponding upper actuation element 10' for a needle 6 when said needle is arranged in the upper needle cylinder. Preferably, said upper actuation element 10' comprises, from the bottom upwardly, a transfer sinker or slider 3', a connecting element 4' and a selector 5', which are preferably provided in the same manner as the ones described hereinafter with reference to the lower needle cylinder 1. The upper needle cylinder, as regards the axial slots and the above mentioned elements accommodated therein, is provided substantially like the lower needle cylinder but in an inverted position. For this reason, the illustration of the upper needle cylinder has been omitted for the sake of simplicity in FIGS. 1 and 2.

Between the two needle cylinders, i.e., in the knitting region, in each of the axial slots there is a needle 6, which is provided with two tips or heads 6*a*, 6*a'*, respectively a lower head 6*a* and an upper head 6*a'*, and which, depending on whether one wishes to provide plain or purl stitches, is moved within the lower needle cylinder 1 so that it knits with its upper tip or head 6*a'* or in the upper needle cylinder so that it knits with its lower tip or head 6*a*.

Since the needle 6 does not have a heel, it is actuated by means of the lower actuation element 10 or by means of the upper actuation element 10', depending on whether it has to form plain or purl stitches.

The sliders 3, the connecting elements 4 and the selectors 5 that are arranged in the axial slots 2 of the lower needle cylinder of the machine according to the invention are described hereinafter, and this description preferably applies also to the sliders 3', to the connecting elements 4' and to the selectors 5' arranged in the axial slots of the upper needle cylinder, taking of course into account the fact that the position of the elements 3', 4', 5' is inverted with respect to the position of the elements 3, 4 and 5 and that the slider 3 can engage the lower head 6*a* of the needle 6 while the slider 3' can engage the upper head 6*a'* of the needle 6.

The slider 3 has an elongated laminar body which is provided, proximate to its longitudinal end directed toward the needle 6, in a per se known manner, with engagement means, constituted by a hook-shaped tab 7, which can engage the lower head 6*a* of the needle 6.

The slider 3 has a first longitudinal side which is directed toward the bottom of the corresponding axial slot 2 and, on its opposite longitudinal side, a fixed heel 3*a* which lies substantially at right angles to the first longitudinal side of the slider 3, i.e., radially with respect to the lower needle cylinder 1, and protrudes radially from the lateral surface of the lower needle cylinder 1 to engage cams 8 for actuating the sliders which face the lateral surface of the lower needle cylinder 1.

The slider 3 has, on its first longitudinal side, proximate to its lower end, an inclined portion which allows it to oscillate on a radial plane of the lower needle cylinder 1 to engage or disengage, by means of the hook-shaped tab 7, the lower head 6*a* of the needle 6.

The connecting element 4 has an elongated laminar body and is connected to the longitudinal end of the slider 3 which lies opposite the end that can be engaged by the needle 6. The connecting element 4 has, on its side directed toward the outside of the lower needle cylinder 1, at least one movable heel 4*a*.

The connecting element 4 can oscillate on a radial plane of the lower needle cylinder 1 with respect to the slider 3 in order to produce the transition of its movable heel 4*a* from an active position, in which the movable heel 4*a* protrudes radially from the corresponding axial slot 2 to engage cams 9 for actuating the connecting elements, to an inactive position, in which the movable heel 4*a* is contained in the corresponding axial slot 2 so that it does not engage the actuation cams 9 of the connecting elements, and vice versa.

The connecting element 4 is preferably pivoted, with its upper longitudinal end, to the lower longitudinal end of the slider 3 which lies opposite the end that can be engaged with the needle 6, about a pivoting axis 11 which is perpendicular to the radial plane of arrangement of the connecting element 4. The pivoting is preferably performed by means of a protrusion 12 which protrudes on the side of the slider 3 that is directed away from the bottom of the axial slot 2 and by a seat 13 which accommodates rotatably said protrusion 12 and is formed within the connecting element 4.

In this manner, a bilateral connection is established between the slider 3 and the connecting element 4 in the sliding movement of the slider 3 and of the connecting element 4 along the axial slot 2 produced by the engagement of the slider 3 or of the connecting element 4 with the corresponding actuation cams 8, 9.

Conveniently, the connecting element 4 has, at its end connected to the slider 3, another heel 4*b* which protrudes radially toward the outside of the needle cylinder 1. This other heel 4*b* can be pressed toward the bottom of the axial slot 2 in order to produce the oscillation of the slider 3 on the radial plane of the needle cylinder 1, on which it lies, in the direction of oscillation which produces the spacing of its longitudinal end provided with the hook-shaped tab 7, i.e., the end directed toward the needle 6, away from the bottom of the axial slot 2 of the lower needle cylinder 1 in which it is accommodated in order to disengage the slider 3 from the lower head 6*a* of the needle 6.

The selector 5 also has an elongated laminar body and is arranged on the opposite side of the slider 3 with respect to the connecting element 4.

The selector 5 has a portion 14 which protrudes between the connecting element 4 and the bottom of the axial slot 2 of the lower needle cylinder 1 in any position that can be assumed by the connecting element 4 during the operation of the machine, so that it is always possible to act, by means of the selector 5, on the connecting element 4.

The selector 5 can oscillate, by way of the action of at least one selection device, on a radial plane of the lower needle cylinder 1 in order to produce the passage of the movable heel 4*a* of the connecting element 4 from the inactive position to the active position.

The side of the selector 5 which is directed toward the bottom of the slot 2 has a portion 15 which is inclined with respect to the remaining part of said side indeed to allow said oscillation of the selector 5.

The selector 5 has, in a region of its longitudinal extension which is spaced from its portion 14, which is interposed between the bottom of the axial slot 2 in which it is accommodated and the connecting element 4, at least one pressable region 16*a*, 16*b*, which can be pushed toward the bottom of the axial slot 2 to produce the oscillation of the connecting element 4 which produces the transition of the movable heel 4*a* from the inactive position to the active position.

In the illustrated embodiment there are two pressable regions, respectively: a pressable region 16*a*, which is located at the longitudinal end of the selector 5 which lies opposite the end directed toward the slider 3, and a pressable region 16*b*, which is arranged in an intermediate region.

The pressable region 16*b* can have an extension, in the longitudinal direction of the selector 5, which is different for the various selectors of the machine, so as to allow diversifiable intervention on the selectors 5 depending on the extension of said pressable region 16*b*.

The oscillation of the selectors 5 in order to produce the transition of the movable heel 4*a* of the connecting element 4 from the inactive position to the active position can be achieved by means of known types of selection devices, such as for example the device disclosed in Italian Patent no. 1,312,277, which allow needle-by-needle selection, i.e., are capable of actuating independently of each other the various selectors of the machine, in particular even two selectors 5 arranged in two contiguous axial slots 2 of the lower needle cylinder 1.

Selection devices of this kind face the lateral surface of the lower needle cylinder 1 and are provided with a pusher or cam which is capable of acting on command on the pressable region 16*a* arranged at the longitudinal end of the selector 5 which lies opposite the portion 14 or on the pressable region 16*b* so as to produce the oscillation of the selector 5 in the direction of oscillation that produces the transition of the movable heel 4*a* of the connecting element 4 from the inactive position to the active position.

In the embodiment shown, for the lower needle cylinder 1 there are five selection points, at each of which there is a selection device, respectively a selection device 21 which is arranged directly upstream of a feed or drop of the machine along one direction of the rotation of the needle cylinders about their own axis and to be used to select the needles that must knit at said feed or drop when the needle cylinders are actuated with that direction of rotation, a selection device 22 which is arranged directly upstream of a feed or drop of the machine along the opposite direction of rotation of the needle cylinders about their own axis and to be used to select the needles that must knit at said feed or drop when the needle cylinders are actuated with said opposite direction of rotation, a selection device 23 to be used during the transfer of the needles from one needle cylinder to the other, and two additional selection devices 24, 25.

Likewise, the following are arranged in each of the axial slots of the upper needle cylinder 1': a slider 3', a connecting element 4' and a selector 5', which are preferably provided like the slider 3, the connecting element 4 and the selector 5 described with reference to the lower needle cylinder 1. The parts of the slider 3', of the connecting element 4' and of the selector 5' that correspond to the parts that have already been described with reference to the slider 3, to the connecting element 4 and to the selector 5 have been designated by the same reference numerals.

It is possible to provide for the upper needle cylinder 1' as well selection devices which are similar to the ones described above, optionally in a smaller number in view of the fact that the need to select the needs when said needles are in the upper needle cylinder is generally smaller, said devices facing the lateral surface of the upper needle cylinder in order to act on the selectors 5' arranged in the upper needle cylinder. In particular, it is possible to provide: a selection device which is similar to the selection device 21 and is located directly upstream of a feed or drop of the machine along one direction of rotation of the needle cylinders about their own axis and is meant be used to select the needles that must knit in the upper needle cylinder at said feed or drop when the needle cylinders are actuated with said direction of rotation and selection devices which are similar to the two additional selection devices 24, 25.

In a manner similar to what has been described with reference to the lower needle cylinder 1, there are cams 8' for actuating the sliders and cams 9' for actuating the connecting elements located in the upper needle cylinder, said cams being arranged around the lateral surface of the upper needle cylinder.

The actuation cams 8, 8' of the sliders and the actuation cams 9, 9' of the selection elements constitute the set of the actuation cams of the actuation elements 10, 10' of the needles 6, which is usually referenced as cam box of the machine, and form paths which can be engaged by the heels 3*a* of the sliders 3, 3' and by the movable heels 4*a*, in the active position, of the connecting elements 4, 4'. These paths are shaped so as to produce the sliding of the sliders 3, 3' and of the selection elements 4, 4', which engage them, along the axial slots of the corresponding needle cylinder in which they are accommodated. This sliding is required in order to form knitting on the part of the needles 6 and for other operating conditions of the machine, such as for example the transfer of the needles 6 from the lower needle cylinder 1 to the upper needle cylinder and vice versa, or in order to keep the sliders 3, 3' in an inactive or non-knitting condition for the needle 6 engaged by them, when the needle cylinders are actuated with a rotary motion about their own axis with respect to the cam box.

It should be noted that in the illustrated embodiment the cam box of the machine according to the invention is composed exclusively of fixed cams.

Figure 3:
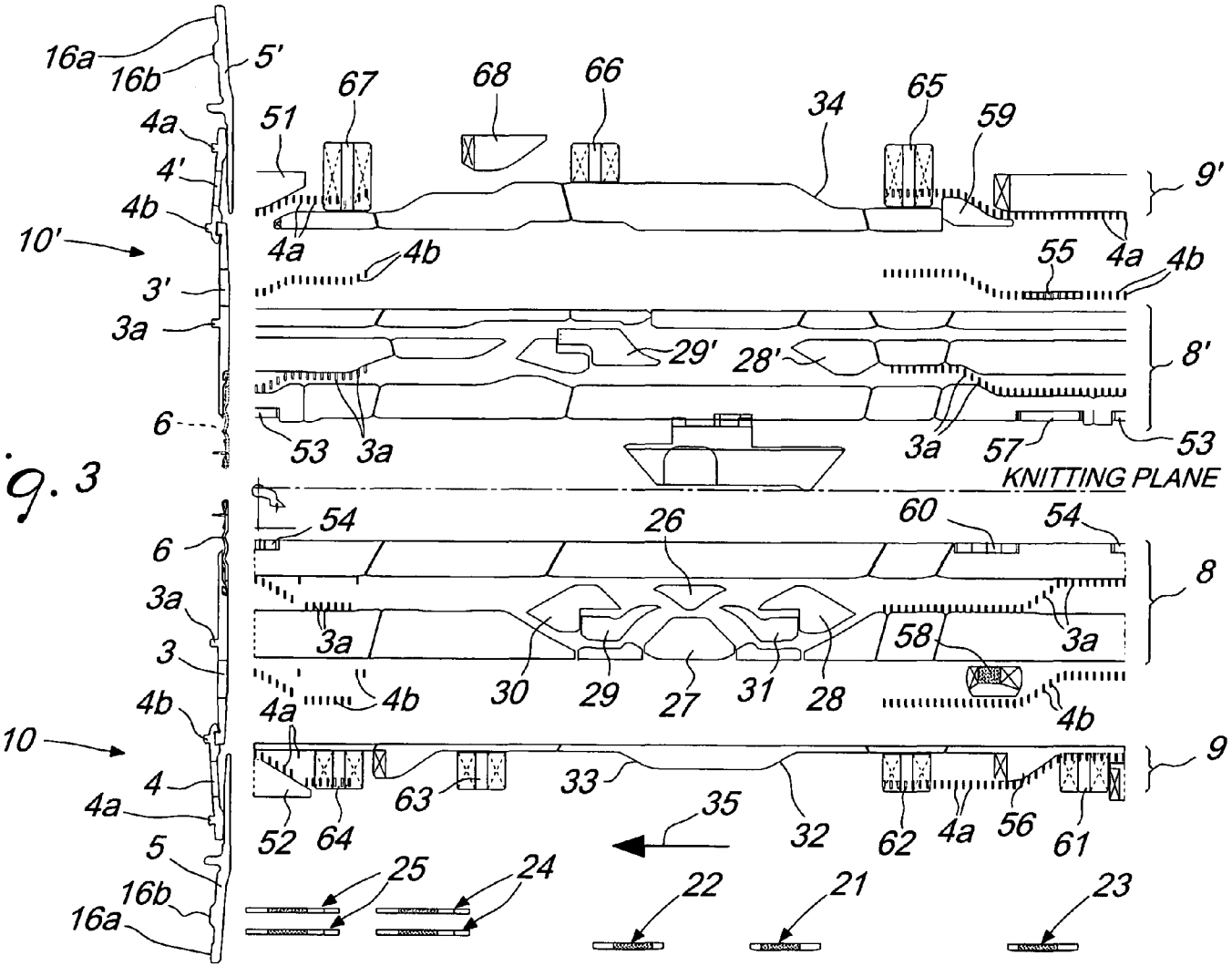
FIG. 3 is a view of a possible embodiment of the set of actuation cams of the needle actuation elements, projected flat and seen from its side which is directed toward the needle cylinders, highlighting the path followed by the heels of the actuation elements of a needle during the transfer of the needle from the upper needle cylinder to the lower needle cylinder.
Figure 4:
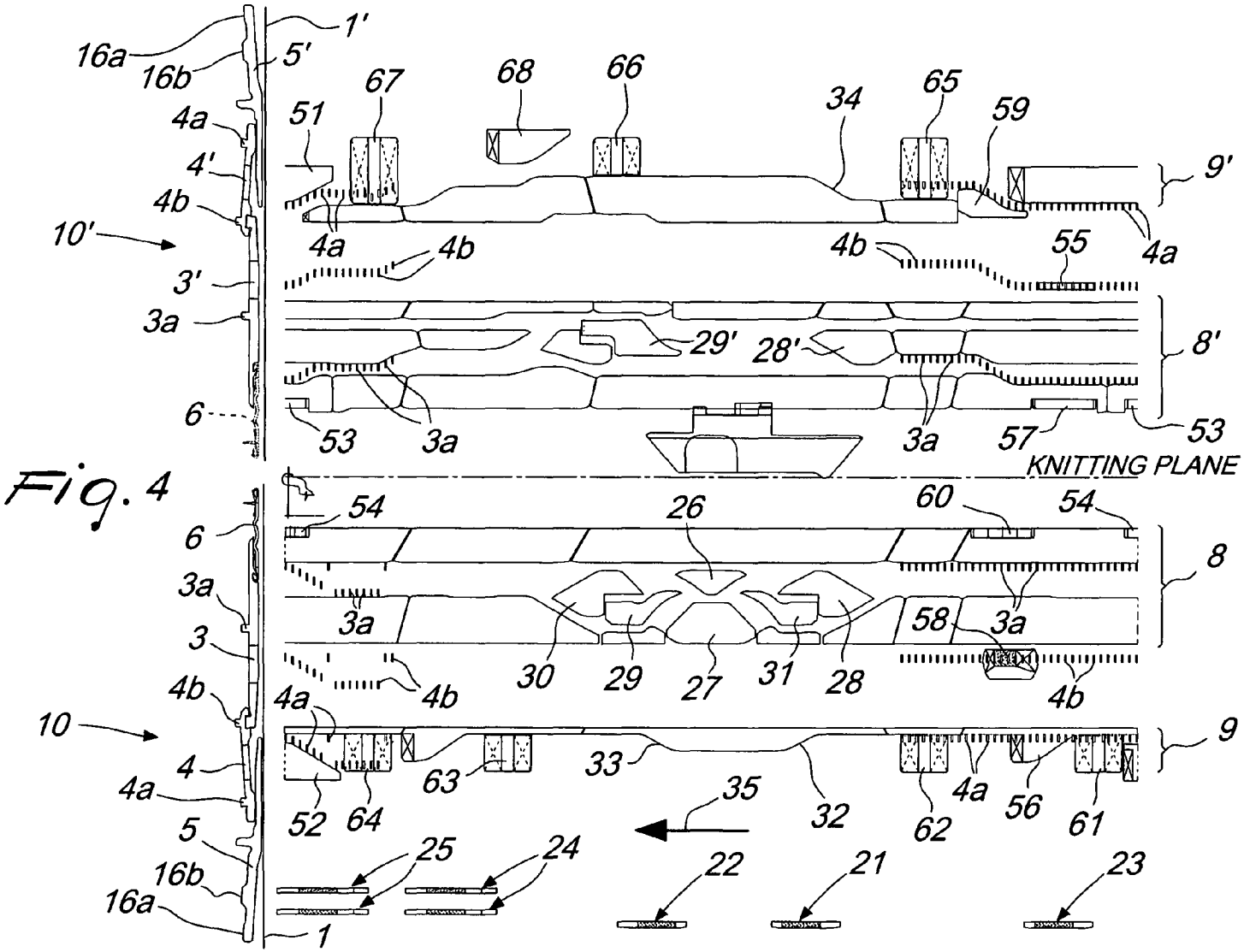
FIG. 4 is a view of the set of the actuation cams of the needle actuation elements, similar to FIG. 3, highlighting the path followed by the heels of the actuation elements of a needle during the transfer of the needle from the lower needle cylinder to the upper needle cylinder.

FIGS. 3 and 4 illustrate a portion of a possible embodiment of the cam box of the machine according to the invention proximate to a feed or drop, at which the needles 6, if arranged in the lower needle cylinder, can form knitting both during the actuation of the needle cylinders of the machine in one direction of rotation and in the opposite direction of rotation about their own axis with respect to the cam box.

For the sake of simplicity in presentation, it is assumed that the machine has only said feed or drop, without altering the fact that the machine can have multiple feeds or drops according to the requirements, which can be used to form knitting during the rotation of the needle cylinders about their own axis in at least one direction of rotation.

At said feed or drop, there are, for the cams 8 for actuating the sliders of the lower needle cylinder, the central cam 26, the central countercam 27, the extraction (or lifting) cam 28, and the knockover cam 29 in the rotary motion of the needle cylinders in one direction, the extraction (or lifting) cam 30 and the knockover cam 31 in the rotary motion of the needle cylinders in the opposite direction. The extraction (or lowering) cam 28' and the knockover cam 29' have been designated among the actuation cams of the sliders 8' of the upper needle cylinder.

Between the actuation cams of the connecting elements 9 of the lower needle cylinder 1 there is a retraction (or lowering) cam 32, which is arranged between the extraction cam 28 and the central cam 26, and there is a retraction (or lowering) cam 33 which is arranged between the extraction cam 30 and the central cam 26, saids cams being used to actuate the connecting elements 4 and therefore the needles 6 during the formation of knitting. In the illustrated embodiment, the retraction cams 32 and 33 are formed monolithically but might also be provided as separate cams.

Between the actuation cams 9' of the connecting elements of the upper needle cylinder there is a retraction cam 34, which is arranged between the extraction cam 28' and the knockover cam 29', and there is an extraction cam 68, said cams being used to actuate the connecting elements 4' and therefore the needles 6 during the formation of knitting.

In addition to the actuation cams 8, 8' of the sliders and the actuation cams 9, 9' of the connecting elements, in the cam box there are pressers 53, 54, 57, 60 in the region of the cams 8, 8' for actuating the sliders, pressers 61, 62, 63, 64, 65, 66, 67 in the region of the cams 9, 9' for actuating the connecting elements, and pressers 55, 58 in the intermediate region between the actuation cams 8, 8' of the sliders and the actuation cams 9, 9' of the connecting elements, which can act respectively on the sliders 3, 3' and on the connecting elements 4, 4' in order to produce their oscillation on a radial plane of the needle cylinders. The functions of some of these elements meant to be used predominantly to transfer the needles from one needle cylinder to the other will become better apparent hereinafter.

These pressers are fixed, i.e., rigidly coupled to the cam box, and therefore do not require any actuator for their operation.

Between the cams 9, 9' for actuating the connecting elements there are cams which predominantly are designed to actuate the connecting elements 4, 4' and therefore the sliders 3, 3' in order to actuate the transfer of the needles 6 from one needle cylinder to the other.

According to the invention, said cams dedicated predominantly to the transfer of the needles from one needle cylinder to the other comprise: an upper fixed lowering cam 51, which can be engaged by the connecting elements 4' arranged in the upper needle cylinder so as to lower the sliders 3' in the position for engaging the corresponding needle 6 and a lower fixed lifting cam 52, which can be engaged by the connecting elements 4 in order to lift the sliders 3 in the position that corresponds to the engagement of the corresponding needle 6.

The upper fixed lowering cam 51 and the lower fixed lifting cam 52 are arranged upstream of the selection device 23 along the direction of rotation of the needle cylinders about their own axis with respect to the actuation cam box indicated by the arrow 35.

Directly downstream of the upper fixed lowering cam 51 and the lower fixed lifting cam 52, along this direction of rotation, between said cams and the selection device 23 there are pressers, respectively an upper closure presser 53 and a lower closure presser 54; any sliders 3' and sliders 3 which might be, with their end which can be engaged with the upper head **6*a*' and with the lower head 6*a* of the corresponding needle 6, in the oscillated condition in which they are spaced from the bottom of the corresponding axial slot 2** respectively engage said pressers.

An upper opening presser 55 is substantially aligned with the selection device 23, faces the lateral surface of the upper needle cylinder and can engage the heel **4*b* of the connecting elements 4' arranged in the upper needle cylinder so as to cause the oscillation of the sliders 3' in order to move their end directed toward the corresponding needle 6 away from the bottom of the corresponding axial slot 2**.

Directly downstream of the selection device 23, again along the direction of rotation indicated by the arrow 35, the lateral surface of the lower needle cylinder 1 is faced by a lower fixed lowering cam 56, which can be engaged exclusively by the connecting elements 4 that are located in the lower needle cylinder 1 and have been moved with their movable heel **4*a* into the active position by said selection device 23**.

Directly after the beginning of the lower fixed lowering cam 56 along the direction of rotation indicated by the arrow 35, the lateral surface of the upper needle cylinder is faced by an upper closure presser 57, which can engage the sliders 3' arranged in the upper needle cylinder so as to produce the oscillation of the sliders 3', in order to move their end directed toward the corresponding needle 6 toward the bottom of the corresponding axial slot 2.

After the lower fixed lowering cam 56, along the direction of rotation indicated by the arrow 35, the lateral surface of the lower needle cylinder faces a lower opening presser 58, which can be engaged exclusively by the heel **4*b* of the connecting elements 4 which are arranged in the lower needle cylinder and have their movable heel 4*a* in the inactive position, i.e., have not engaged the lower fixed lowering cam 56. The lower opening presser 58 is meant to produce the oscillation of the sliders 3, which engage it, in order to move their end directed toward the corresponding needle 6 away from the bottom of the corresponding axial slot 2**.

Finally, downstream of the lower opening presser 58, again along the direction of rotation indicated by the arrow 35, the lateral surface of the upper needle cylinder 1' is faced by a fixed upper lifting cam 59, which can be engaged by the heel **4*a* of the connecting elements 4' arranged in the upper needle cylinder, and the lateral surface of the lower needle cylinder is faced by a lower closure presser 60, which can be engaged by the sliders 3 in order to return the sliders 3 on which the lower opening presser 58 has acted into the position in which their end directed toward the needle 6 is approaching the bottom of the corresponding axial slot 2**.

Operation of the machine according to the invention, as regards the execution of the transfer of the needles from one needle cylinder to the other, is as follows.

FIGS. 3 and 4 illustrate the path followed by the heels **3*a*, 4*a*, 4*b* of a slider 3, 3' and of a connecting element 4, 4'** which is associated therewith during the transfer operation.

In order to distinguish the active position from the inactive position of the heels **4*a* of the connecting elements 4, 4', the heels 4*a*** in the active position are shaded, while the heels in the inactive position are not shaded.

When it is necessary to transfer a needle 6 from one needle cylinder to the other, the beginning of the transfer operation is actuated by means of the selection devices 25 and the corresponding selection devices which face the upper needle cylinder, which move all the connecting elements 4, 4' arranged in the lower needle cylinder and in the upper needle cylinder so that their heel **4*a* is in the active position, while the needle cylinders are actuated with a rotary motion about their own axis in the direction indicated by the arrow 35**.

The connecting elements 4 arranged in the lower needle cylinder therefore engage with their heel 4*a* the lower fixed lifting cam 52 and the connecting elements 4' arranged in the upper needle cylinder engage with their heel 4*a* the upper fixed lowering cam 51. The engagement of the connecting elements 4, 4' with said cams 51 and 52 produces the mutual approach of the sliders 3, 3' arranged in the upper needle cylinder and in the lower needle cylinder, causing the overlap of their longitudinal end with the hook-shaped tab 7 with respect to the corresponding head 6*a*, 6*a*' of the needle 6. For this reason, the sliders 3, 3' that are not previously engaged with the corresponding needle 6, as a consequence of the particular configuration of the hook-shaped tab 7 and of their sliding on the corresponding head 6*a*, 6*a*' of the needle 6 undergo an oscillation on the radial plane which causes the hook-shaped tab 7 to move away from the bottom of the corresponding axial slot 2 in which the slider 3, 3' is accommodated. Subsequently, the sliders that have undergone this oscillation engage the lower closure presser 54 or the upper closure presser 53, which produce the oscillation in the opposite direction of the sliders 3, 3', causing their engagement with the corresponding head 6*a*, 6*a*' of the needle. In this manner, a needle 6 is simultaneously engaged by the slider 3 and by the slider 3'.

At this point, by means of the selection device 23, the connecting elements 4 that must transfer the needles 6 from the lower needle cylinder to the upper needle cylinder are selected. Directly before the selection device 23, the presser 61 produces the transition of the heels 4*a* of the connecting elements 4, arranged in the lower needle cylinder, into the inactive position. The selection device 23 acts on the connecting elements 4 arranged in the lower needle cylinder and connected to the sliders 3 which must remain engaged with the corresponding needle 6 so as to move said needle 6 so that it knits in the lower needle cylinder, causing the transition of their heel 4*a* from the inactive position to the active position.

Substantially simultaneously with this selection operation, the sliders 3' arranged in the upper needle cylinder undergo the action of the upper opening presser 55, which produces the oscillation of all the sliders 3' arranged in the upper needle cylinder so as to move their hook-shaped tab 7 away from the bottom of the corresponding axial slot 2.

The heels 4*a* of the connecting elements 4 arranged in the lower needle cylinder that have been moved into the active position therefore engage the lower fixed lowering cam 56, which produces their lowering and therefore the entrainment into the lower needle cylinder of the needles 6 that are engaged with them, as shown in FIG. 3. As soon as this lowering has begun, the sliders 3' arranged in the upper needle cylinder encounter the upper closure presser 57, which produces the oscillation of the sliders 3' in the direction that moves their hook-shaped engagement tab 7 toward the bottom of the corresponding axial slot 2, as shown in FIG. 3. This oscillation has no effect on the needles that in the meantime have begun their descent in the lower needle cylinder as a consequence of the engagement of the corresponding connecting elements 4 with the lower fixed lowering cam 56, but produces the new engagement of the hook-shaped tab 7 of the sliders 3' with the corresponding needle, which is instead engaged by the sliders 3 arranged in the lower needle cylinder which have not engaged with their heel the lower fixed lowering cam 56, as shown in FIG. 4.

The sliders 3 that have not engaged the lower fixed lowering cam 56 therefore encounter the lower opening presser 58, which produces their oscillation in the direction which moves the hook-shaped tab 7 away from the bottom of the corresponding axial slot 2, producing the disengagement of said sliders 3 from the lower head 6*a* of the corresponding needle 6.

The connecting elements 4' arranged in the upper needle cylinder therefore engage with their heel 4*a* the upper fixed lifting cam 59, which causes their rise and therefore also causes the rise of the corresponding needles, which have been disengaged from the slider 3 arranged in the lower needle cylinder, into the upper needle cylinder, as shown in FIG. 4.

At this point, the transfer of the needles from one needle cylinder to the other is completed and the sliders 3 connected to the connecting elements 4, arranged in the lower needle cylinder, that have engaged with the heel 4*b* the lower opening presser 58, are again made to oscillate in the opposite direction by engagement with another lower closure presser 60 which faces the lateral surface of the lower needle cylinder.

Operation of the machine in the production of knitting is disclosed in a copending Italian patent application MI2006A000628, filed Mar. 31, 2006.

In practice it has been found that the machine according to the invention fully achieves the intended aim, since it is capable of transferring the needles from one needle cylinder to the other without resorting to the use of movable actuation cams and with a transfer sequence which is faster than obtainable with machines of the traditional type.

The machine thus conceived is susceptible of numerous modifications and variations, all of which are within the scope of the appended claims; all the details may further be replaced with other technically equivalent elements.

In practice, the materials used, as well as the dimensions, may be any according to requirements and to the state of the art.

The disclosures in Italian Patent Application No. MI2006A000636 from which this application claims priority are incorporated herein by reference.

What is claimed is:

1. A double-cylinder circular knitting machine for hosiery or other knitted articles, comprising a lower needle cylinder which has a vertical axis and an upper needle cylinder which is arranged above and coaxially with respect to said lower needle cylinder; mutually aligned axial slots being formed on the lateral surface of the lower needle cylinder and on the lateral surface of the upper needle cylinder, each of the axial slots of the lower needle cylinder and of the upper needle cylinder accommodating at least one element for actuating a needle; said actuation element being engageable, by one of its ends, with the head of a needle and being provided with at least one fixed heel, which protrudes radially from the lateral surface of the corresponding needle cylinder to engage actuation cams which are arranged around the lateral surface of the needle cylinders and form paths which are followed by said fixed heel as a consequence of the actuation of said needle cylinders with a rotary motion about their own axis with respect to said actuation cams, at least the actuation elements arranged in the lower needle cylinder are provided with a heel which is moveable on command from an active position, in which the heel protrudes radially from the corresponding axial slot of the needle cylinder to engage said actuation cams, to an inactive position, in which the heel is contained in said axial slot of the needle cylinder so as to not engage said actuation cams, and vice versa, wherein, for transferring the needles from one needle cylinder to the other, it comprises, sequentially along the path followed by the actuation elements as a consequence of the rotation of the needle cylinders with respect to the actuation cams:

an upper fixed lowering cam, which is engageable by the actuation elements arranged in the upper needle cylinder for their lowering into a position for engaging the upper head of the corresponding needle, and a lower fixed lifting cam, which is engageable by the actuation elements arranged in the lower needle cylinder to raise them into a position for engaging the lower head of the corresponding needle;

a transfer selection device, which moves the actuation elements that correspond to the needles to be transferred into the lower needle cylinder so that their movable heel is in the active position, and an upper opening presser, which is engageable with the actuation elements arranged in the upper needle cylinder to produce their disengagement from the upper head of the corresponding needle;

a lower fixed lowering cam, which is engageable exclusively by the actuation elements arranged in the lower needle cylinder and moved with their movable heel into the active position by said transfer selection device;

a lower opening presser, which is engageable exclusively by the actuation elements that are arranged in the lower needle cylinder and are arranged so that their movable heel is in the inactive position in order to disengage them from the lower head of the corresponding needle;

an upper closure presser, which engages the actuation elements arranged in the upper needle cylinder for their engagement with the corresponding needle;

an upper fixed lifting cam, which is engaged by the actuation elements located in the upper needle cylinder.

2. The machine according to claim 1, further comprising a lower closure presser, which is arranged downstream of said upper lifting cam along the direction of rotation of the needle cylinders with respect to said actuation cams and engages the actuation elements arranged in the lower needle cylinder on which said lower opening presser has acted previously in order to return them to their position prior to the intervention of said lower opening presser.

3. The machine according to claim 1, further comprising another upper closure presser and another lower closure presser, which are arranged downstream of said upper fixed lowering cam and said lower fixed lifting cam and upstream of said transfer selection device along the direction of rotation of the needle cylinders about their axis with respect to said actuation cams; said other pressers being engageable respectively with the upper actuation elements and the lower actuation elements moved into a position for engagement with the corresponding needle by said upper fixed lowering cam and by said lower fixed lifting cam.

4. The machine according to claim 1, wherein at least at the actuation element that is arranged in each of the axial slots of the lower needle cylinder comprises:

a slider which is provided, proximate to one of its longitudinal ends, with means for engaging the head of a needle; said slider having a first longitudinal side which is directed toward the bottom of the corresponding axial slot of the needle cylinder and having, on its opposite longitudinal side, a fixed heel, which constitutes said fixed heel of the actuation element; said fixed heel protruding substantially at right angles to said first longitudinal side and protruding radially from the lateral surface of the needle cylinder in order to engage corresponding cams for actuating the sliders which face the lateral surface of the needle cylinder;

a connecting element, which is connected to the longitudinal end of said slider which lies opposite the end that engages the needle and is provided, on its side directed toward the outside of the needle cylinder, with at least one movable heel, which constitutes said movable heel of the actuation element; said connecting element being able to oscillate on a radial plane of the needle cylinder with respect to said slider for the transition of said movable heel from an active position, in which said movable heel protrudes radially from the corresponding axial slot of the needle cylinder to engage corresponding cams for actuating the connecting elements which face the lateral surface of the needle cylinder, to an inactive position, in which said movable heel is contained in said axial slot of the needle cylinder in order to not engage said actuation cams of the connecting elements, and vice versa;

a selector which is arranged on the opposite side of the slider with respect to said connecting element; said selector having a portion which protrudes between said connecting element and the bottom of the axial slot of the needle cylinder in which it is accommodated in any position which is assumed by said connecting element during the operation of the machine; said selector being able to oscillate, by way of the action of at least one selection device, on a radial plane of the needle cylinder in order to produce the transition of said movable heel of the connecting element from said inactive position to said active position.

5. The machine according to claim 4, wherein said connecting element is pivoted, with one of its longitudinal ends, to the longitudinal end of said slider which lies opposite the end that engages the needle about a pivoting axis which is perpendicular to said radial plane.

6. The machine according to claim 4, wherein the pivoting between said slider and said connecting element is constituted by a protrusion which protrudes on the side of said slider which is directed away from the bottom of the axial slot of the needle cylinder in which it is accommodated and by a seat which accommodates rotatably said protrusion and is formed in said connecting element.

7. The machine according to claim 4, wherein said slider oscillates on a radial plane of the needle cylinder for the engagement of the head of the needle or the release of the head of the needle on the part of its longitudinal end which lies opposite the longitudinal end connected to said connecting element.

8. The machine according to claim 4, wherein said connecting element has, at its end connected to said slider, a second heel which protrudes radially toward the outside of the needle cylinder, said second heel being pressable toward the bottom of the axial slot in order to produce the oscillation of the slider on said radial plane in the direction which produces the spacing of its longitudinal end directed toward the needle away from the bottom of the axial slot of the needle cylinder in which it is accommodated.

9. The machine according to claim 4, wherein said selector has, in a region of its longitudinal extension which is spaced from its portion which is interposed between the bottom of the axial slot in which it is accommodated and said connecting element, a region which is pressed toward the bottom of the axial slot in order to produce the oscillation of the selector and consequently the passage of said movable heel of the connecting element from the inactive position to the active position.

10. The machine according to claim 4, wherein the actuation elements of the needles arranged in the upper needle cylinder also are provided, in addition to said fixed heel, with a heel which moves on command from an active position, in which it protrudes radially from the corresponding axial slot of the needle cylinder to engage corresponding actuation cams, to an inactive position, in which it is contained in the corresponding axial slot of the needle cylinder so as to not engage said corresponding actuation cams, and vice versa.

11. The machine according to claim 10, wherein the actuation elements arranged in the axial slots of the upper needle cylinder are provided substantially like the actuation elements arranged in the axial slots of the lower needle cylinder.

12. The machine according to claim 4, wherein said at least one selection device is adapted to actuate said selectors independently of each other.

13. The machine according to claim 4, further comprising additional fixed pressers, which face laterally the needle cylinder and engages said heels of the connecting element to produce the oscillation of said slider and/or of said connecting element on said radial plane of the needle cylinder.

* * * * *